US007336473B2

(12) United States Patent
Gross

(10) Patent No.: US 7,336,473 B2
(45) Date of Patent: Feb. 26, 2008

(54) SINGLE-PATH ELECTRICAL DEVICE AND METHODS FOR CONVEYING ELECTRICAL CHARGE

(75) Inventor: Robert R. Gross, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 466 days.

(21) Appl. No.: 10/981,950

(22) Filed: Nov. 5, 2004

(65) Prior Publication Data

US 2006/0098378 A1 May 11, 2006

(51) Int. Cl.
*H05F 3/00* (2006.01)

(52) U.S. Cl. ..... 361/232; 361/218

(58) Field of Classification Search ..... 361/212, 361/217, 218, 220, 232; 42/1.08; 102/502; 463/47.3, 47.4

See application file for complete search history.

(56) References Cited

U.S. PATENT DOCUMENTS 3,775,638 A * 11/1973 Tidman ..... 315/36
4,323,946 A * 4/1982 Traux ..... 361/218
4,453,196 A * 6/1984 Herr ..... 361/232
4,926,284 A * 5/1990 Eugenio ..... 361/117
5,103,366 A * 4/1992 Battochi ..... 361/232
5,247,420 A * 9/1993 Bakhoum ..... 361/212

* cited by examiner

*Primary Examiner*—Michael Sherry
*Assistant Examiner*—Danny Nguyen
(74) *Attorney, Agent, or Firm*—Schwegman, Lundberg & Woessner, P.A.; Gregory J. Gorrie

(57) ABSTRACT

A single-path electrical device generates a conductive channel through the air to alternatively convey charge to a target and remove charge from the target. The single-path electrical device uses either a grounding sphere or grounding torroid to store and at least partially dissipate opposite charge. In this way, neither the target nor the single-path electrical device is required to be grounded. The single-path electrical device may operate at a low frequency to help overcome any surface effects of the target.

30 Claims, 4 Drawing Sheets

SINGLE-PATH ELECTRICAL DEVICE AND METHODS FOR CONVEYING ELECTRICAL CHARGE

TECHNICAL FIELD

Embodiments of the present invention pertain to conveying high-voltage charge. Some embodiments pertain to stun devices, some embodiments pertain to directed energy devices, some embodiments pertain to conductive-stream devices, and some embodiments pertain to laser-induced plasma channeling.

BACKGROUND

Many conventional devices for conveying a high-voltage electrical charge to a target require a return path for the current. For example, some conductive stream devices use a conductive liquid stream to convey current to a target. These devices require that both the target and the device be grounded to provide a return path for the current. One problem with requiring a return path is that the target and/or the device may easily become ungrounded making the device either ineffective or highly dangerous.

Some electrical current conveying devices use a pair of darts coupled with wire conductors to transfer electric current to a target. One wire conductor serves as the return path for current conveyed by the other. One problem with these devices is that when both darts fail to hit and lodge in a target, the return path is not provided. This significantly reduces the effectiveness of such devices.

Thus there are general needs for devices and methods that convey electrical charge without requiring a path for return current.

SUMMARY

A single-path electrical device generates a conductive channel through the air to convey charge to a target and remove charge from the target. The single-path electrical device uses a grounding surface element to store and at least partially dissipate opposite charge. The grounding surface element may have a corona point may be a grounding sphere or grounding torroid. In this way, neither the target nor the single-path electrical device is required to be grounded. The single-path electrical device may operate at a low frequency to help overcome any surface effects of the target.

BRIEF DESCRIPTION OF THE DRAWINGS

The appended claims are directed to some of the various embodiments of the present invention. However, the detailed description presents a more complete understanding of embodiments of the present invention when considered in connection with the figures, wherein like reference numbers refer to similar items throughout the figures and:

DETAILED DESCRIPTION

The following description and the drawings illustrate specific embodiments of the invention sufficiently to enable those skilled in the art to practice them. Other embodiments may incorporate structural, logical, electrical, process, and other changes. Examples merely typify possible variations. Individual components and functions are optional unless explicitly required, and the sequence of operations may vary. Portions and features of some embodiments may be included in or substituted for those of others. Embodiments of the invention set forth in the claims encompass all available equivalents of those claims. Embodiments of the invention may be referred to, individually or collectively, herein by the term "invention" merely for convenience and without intending to voluntarily limit the scope of this application to any single invention or inventive concept if more than one is in fact disclosed.

Figure 1:
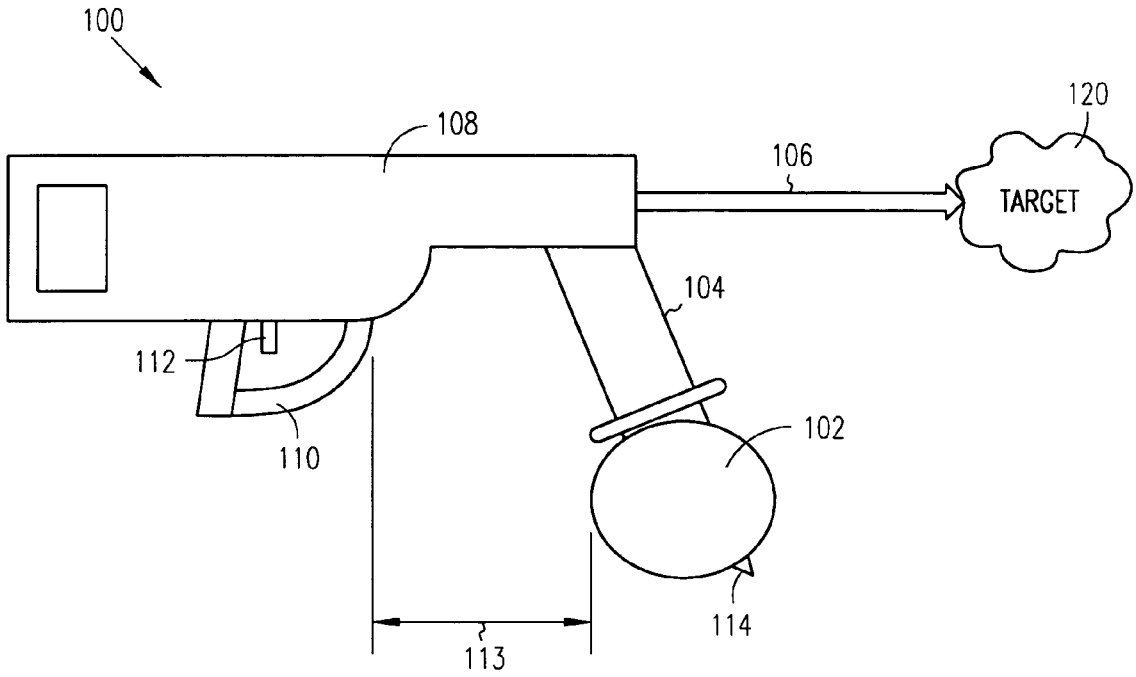
FIG. 1 illustrates a single-path electrical device for conveying electrical charge in accordance with some embodiments of the present invention.

FIG. 1 illustrates a single-path electrical device for conveying electrical charge in accordance with some embodiments of the present invention. Single-path electrical device 100 may include conductive-path generator 108 to generate conductive channel 106, one or more grounding surface elements 102 and high-current, high-voltage generator 104 to propagate a high-voltage electrical charge through conductive channel 106. High-current, high-voltage generator 104 may also concurrently provide an opposite amount of charge to grounding surface element 102. In this way, a return path for the charge conveyed through channel 106 may not be required.

In some embodiments, grounding surface element 102 may have a large surface area to store an amount of charge substantially equal and opposite to an amount of charge conveyed by high-voltage generator 104 through conductive channel 106. In some embodiments, grounding surface element 102 may be a grounding sphere and may be substantially spherical or substantially round in shape. In other embodiments, grounding surface element 102 may be a grounding torroid and have a torroidal shape. In some other embodiments grounding surface element 102 may have an elliptical or other three-dimensional shape suitable to distribute and store charge over a large conductive surface area.

The amount of charge that grounding surface element 102 may store may depend on, among other things, the voltage output of high-voltage generator 104. In embodiments when high-voltage generator 104 provides about 150,000 volts, the one or more grounding surface elements 102 may store up to about 20 pF of charge. In embodiments when high-voltage generator 104 provides about 250,000 volts, the one or more grounding surface elements 102 may only need to store up to about 10 pF of charge. In some embodiments, grounding surface element 102 may have a diameter of about sixteen centimeters when it's spherically shaped. In some embodiments when two grounding surface elements 102 are included, grounding surface elements 102 may have a diameter of about eight centimeters when they are spherically shaped. The selection of the voltage level and charge storage capacity of grounding surface element 102 may also depend on the corona delivery losses and resistance of channel 106.

In some embodiments, single-path electrical device 100 may be ungrounded and grounding surface element 102 may use one or more corona points 114 to dissipate at least some of the charge stored thereon. In some embodiments, one or more of corona points 114 may dissipate the charge the through air, although the scope of the invention is not limited in this respect. In embodiments when target 120 and/or the single-path electrical device 100 are ungrounded, there is really no return path for the charge conveyed through channel 106. In these embodiments, high-voltage generator 108 may remove at least some charge from grounding surface element 102 when providing/sending charge through channel 106, and may provide opposite charge to grounding surface element 102 when removing/receiving charge through channel 106. In this way, grounding surface element 102 may operate as a floating ground.

In some embodiments, conductive channel 106 may be a single conductive channel comprising a single conductive current path. At any given instant during the operation of single-path electrical device 100, charge may flow in one direction through the single conductive channel either from target 120 or to target 120 without any return path.

In some embodiments, high-current, high-voltage generator 104 is an alternating polarity generator that regularly reverses current flow through conductive channel 106 at a low frequency. In some embodiments, the alternating-polarity generator propagates and reverses the charge flow through conductive channel 106 at the low frequency to stun, shock and/or incapacitate an ungrounded target by transferring current to and removing current from the target at the low frequency. In some embodiments, the low frequency may be between approximately 10 Hz and 50 Hz, although higher and lower frequencies may also be suitable. In some embodiments, low frequencies (e.g., below 50 Hz) may more easily penetrate the surface of target 120, especially if the surface is somewhat conductive. For example, low frequencies may more easily penetrate shielding or wet clothing of a person or a metallic surface of other types of targets. In some embodiments, higher frequencies may be used, especially when single-path electrical device 100 is used for disabling electronic devices and/or used in air-to-air situations.

In some embodiments, one or more of corona points 114 may dissipate at least some of the charge when the current flow is reversed by high-voltage generator 104. In some embodiments, the dissipation of charge by one or more of corona points 114 may allow an increased amount of charge to be conveyed through conductive channel 106 to target 120, especially when target 120 is ungrounded.

Although in many embodiments, conductive channel 106 is described as a single conductive channel having a single conductive path, this is not a requirement. In some other embodiments, conductive channel 106 may comprise more than one conductive path (i.e., a dual path). In some of these other embodiments, each conductive path may convey current in the same direction concurrently. In these embodiments, one path does not serve as a return path for the other. Accordingly, single-path electrical device 100 may still be operational and may still convey charge to target 120 even when both conductive paths may inadvertently short together.

When target 120 is grounded, a partial return current path may be provided by one or more of corona points 114 through the air to ground, although the scope of the invention is not limited in this respect. On the other hand, when target 120 is ungrounded, current flows through channel 106 and charge may build up on target 120. If the charge is sufficiently large, the charge may arc to ground (e.g. through shoes).

In some embodiments, conductive-path generator 108 comprises a laser which generates a conductive plasma channel by photo-ionizing air prior to high-voltage generator 104 propagating the high-voltage electrical charge through the conductive plasma channel. In some embodiments, the laser may be an ultra-violet (UV) laser, although other lasers, such as $CO_2$ and infrared (IR) lasers may also be used. In some embodiments, the laser may operate at a wavelength of approximately 192 nanometers, although this is not a requirement. The power level and/or operating wavelength of the laser may be selected to ionize a path to an intended target.

In some embodiments, conductive-path generator 108 generates a conductive wire channel comprising one or more wire conductors by firing the one or more wire conductor to a target. In some of these embodiments, the one or more wire conductors may have a dart on its end to stick to or embed in the target, although the scope of the invention is not limited in this respect. In these embodiments, current may flow through each of the one or more wire conductors concurrently in the same direction.

In some embodiments, conductive channel 106 comprises a conductive fluid stream. In these embodiments, conductive-path generator 108 may pressurize a fluid and may fire the fluid to generate the conductive fluid stream to electrically couple target 120 with single-path electrical device 100. In some embodiments, especially those that convey charge through a fluid stream, single-path electrical device 100 may include a second grounding surface element electrically parallel to grounding surface element 102. In these embodiments, the two grounding surface elements may be located on opposite sides of single-path electrical device 100, and may be located in substantially horizontal opposite positions when conductive-path generator 108 generates the conductive fluid stream. In some embodiments, the first and second grounding elements may be grounding spheres or torroids and may be located in substantially horizontal opposite positions so that a conductive fluid stream comprising channel 106 doesn't drip on the grounding spheres causing a short, although the scope of the invention is not limited in this respect. In embodiments that use two or more parallel grounding spheres or torroids, the size of the spheres or torroids may be reduced because less charge may have to be stored on each one. In some of these embodiments, single-path electrical device 100 may include a tank to store fluid for the conductive fluid stream and a pump to pressurize the fluid for firing at target 120, although the scope of the invention is not limited in this respect. In some embodiments, the fluid may be almost any conductive fluid or liquid including, for example, water or salt water.

In some embodiments, a stream of plasma may be used as a conductive fluid. In these embodiments, the stream of plasma may be generated from a tesla coil operating between about 150,000 and 250,000 volts, for example, and may be directed in a particular direction with a high-voltage electrode. In some embodiments, argon gas may be used to help direct the stream of plasma, although the scope of the invention is not limited in this respect.

In some hand-held embodiments, single-path electrical device 100 may include hand guard 110 and trigger 112. In these embodiments, distance 113 may be provided between hand guard 110 and grounding surface element 102 to help reduce the risk of grounding surface element 102 discharging to the user. In these embodiments, hand guard 110 may comprise a high-voltage insulator. Distance 113 may depend on the charge and/or voltage level of grounding surface element 102, and in some embodiments, may be about thirty centimeters, although the scope of the invention is not limited in this respect.

Figure 2:
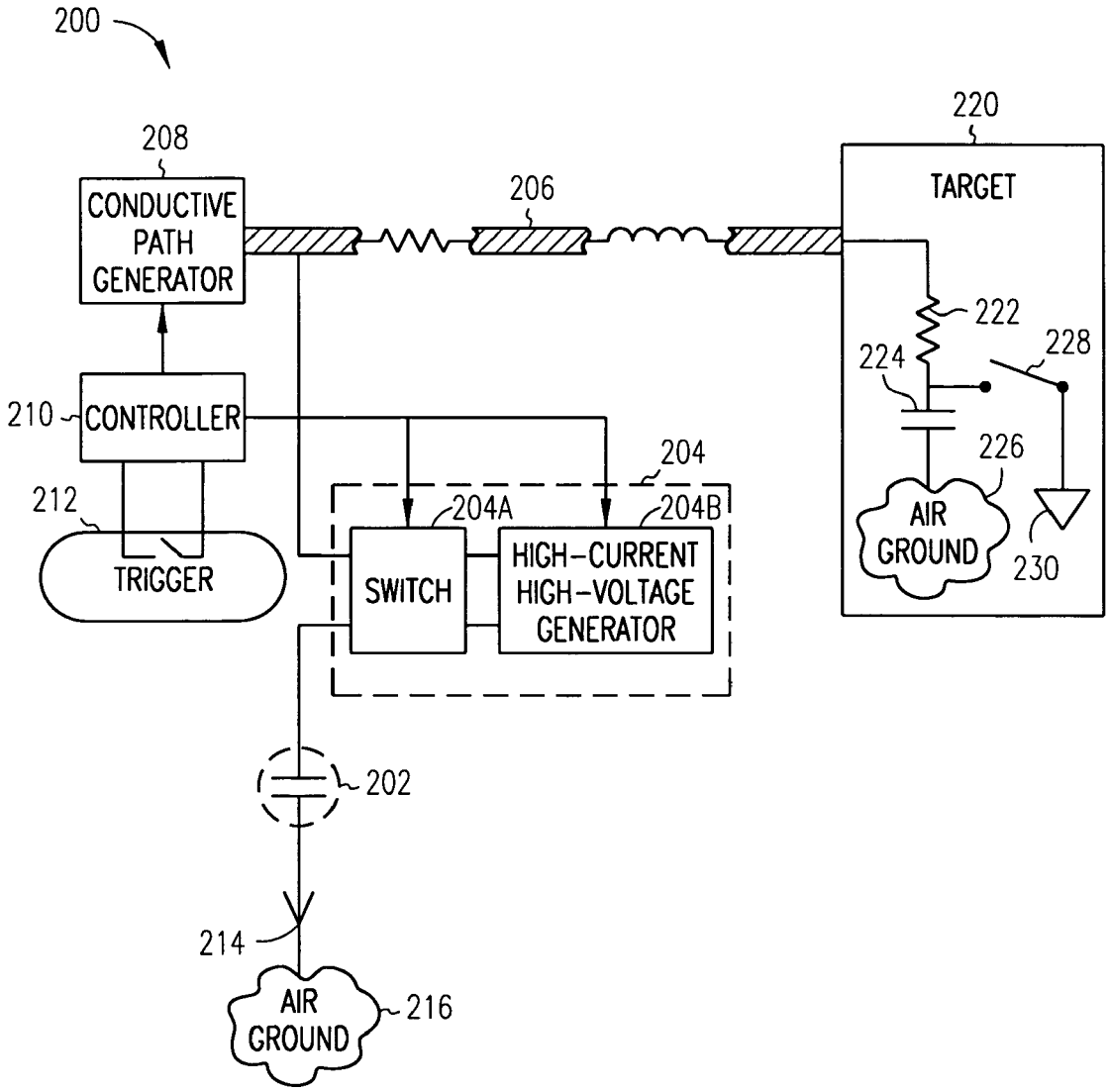
FIG. 2 is a functional block diagram of a single-path electrical device for conveying electrical charge in accordance with some embodiments of the present invention.

FIG. 2 is a functional block diagram of a single-path electrical device for conveying electrical charge in accordance with some embodiments of the present invention.

Single-path electrical device 200 may correspond to single-path electrical device 100 (FIG. 1). In addition to single-path electrical device 200, FIG. 2 also illustrates conductive channel 206 which may correspond to conductive channel 106 (FIG. 1), and target 220 which may correspond to target 120 (FIG. 1).

As illustrated in FIG. 2, single-path electrical device 200 may include grounding surface element 202, which may correspond to grounding surface element 102 (FIG. 1), coupled to high-current, high-voltage generator 204, which may correspond to high-current, high-voltage generator 104 (FIG. 1). Grounding surface element 202 may include one or more corona points 214 for dissipating charge by air ground 216. Single-path electrical device 200 also includes conductive-path generator 208, which may correspond to conductive path generator 108 (FIG. 1). In some embodiments, single-path electrical device 200 may include system controller 210, which may control the operation of conductive-path generator 208 and high-current, high-voltage generator 204 in response to input from trigger 212.

Although single-path electrical devices 100 (FIG. 1) and 200 illustrate only one corona point, more than one corona point may be included. In some embodiments, the corona points may be needle electrodes, although edge electrodes may also be used.

In some embodiments, controller 210 may control the energy level or amount of charge, which may be provided in pulses, by high-current, high-voltage generator 204. In some embodiments, controller 210 may receive an input from a user to select a stun setting or kill setting. In some embodiments, controller 210 may be responsive to a range finder to control the energy level based on a distance to a target.

In some embodiments, high-current, high-voltage generator 204 may be an alternating polarity Marx generator which reverses the direction (i.e., polarity) of charge flowing through the conductive channel 206 at a low frequency. In some embodiments, high-current, high-voltage generator 204 comprises Marx generator 204B and switch 204A responsive to controller 210 to reverse the direction (i.e., polarity) of charge flowing through conductive channel 206 at a low frequency. In some embodiments, high-current, high-voltage generator 204 may include a plurality of capacitors that may be charged in parallel and may be discharged in series. In some embodiments, single-path electrical device 200 may also include a power source not illustrated for charging high-current, high-voltage generator 204. In some embodiments, the power source may comprise one or more batteries or fuel cells, although the scope of the invention is not limited in this respect.

In some embodiments, high-current, high-voltage generator 204 may generate up to 200,000 amps or more of current at up to 2,000,000 volts or more, although the scope of the invention is not limited in this respect. In some embodiments, the pulse width and current provided by high-current, high-voltage generator 204 may be determined and/or controlled by system controller 210 based on the type of target 220.

In some situations, when target 220 is ungrounded, target 220 may be schematically represented by resistance 222, capacitance 224 and ground 226. Capacitance 224 represents the target's capacitance and resistance 222 represents a target's internal resistance. In these situations, charge may be transferred to target 220 (e.g., onto capacitance 224) and may be removed from the target (e.g., removed from capacitance 224) through channel 206. In some cases, some charge may transfer to ground 226 (i.e., arc to ground) if the voltage becomes great enough, although this is not a requirement.

In some situations, when target 220 is grounded, target 220 may be schematically represented by resistance 222 with direct connection 228 to ground 230. In these situations, charge flowing through channel 206 will have a return path through ground 230 and through corona point 214 back to single-path electrical device 200.

Accordingly, single-path electrical device 200 may convey charge to target 220 whether or not target 220 is grounded. Charge may be removed from target 220 either through channel 206 or by ground 230. Furthermore, single-path electrical device 200 may convey charge to target 220 whether or not single-path electrical device 200 is grounded.

In some embodiments, single-path electrical device 200 may be a platform mounted device and may be located on an airborne platform such as an aircraft or missile. In these embodiments, controller 210 may be responsive to input from a proximity detection system and may instruct conductive path generator 208 to generate a conductive channel through the atmosphere to a target, such as another aircraft or missile. Furthermore, controller 210 may cause high-current, high-voltage generator 204 to discharge through the channel alternatively providing charge and removing charge from the target while concurrently removing charge from and providing charge to grounding surface element 202. In some of these embodiments, an outside conductive surface capacitance of the airborne platform may serve to store charge in place of grounding surface element 202, although the scope of the invention is not limited in this respect.

In some embodiments, single-path electrical device 200 may be air-to-air device and may be part of an airborne platform comprising either a missile or aircraft. In these embodiments, grounding surface element 202 may be an external conductive surface of the airborne platform. In these embodiments, target 220 may be a second airborne platform comprising either a missile or aircraft.

As used herein, the terms "removing charge" may be interpreted as providing an opposite charge, while the terms "providing charge" may be interpreted as removing an opposite charge. Although system 200 is illustrated as having several separate functional elements, one or more of the functional elements may be combined and may be implemented by combinations of software-configured elements, such as processing elements including digital signal processors (DSPs), and/or other hardware elements.

Figure 3:
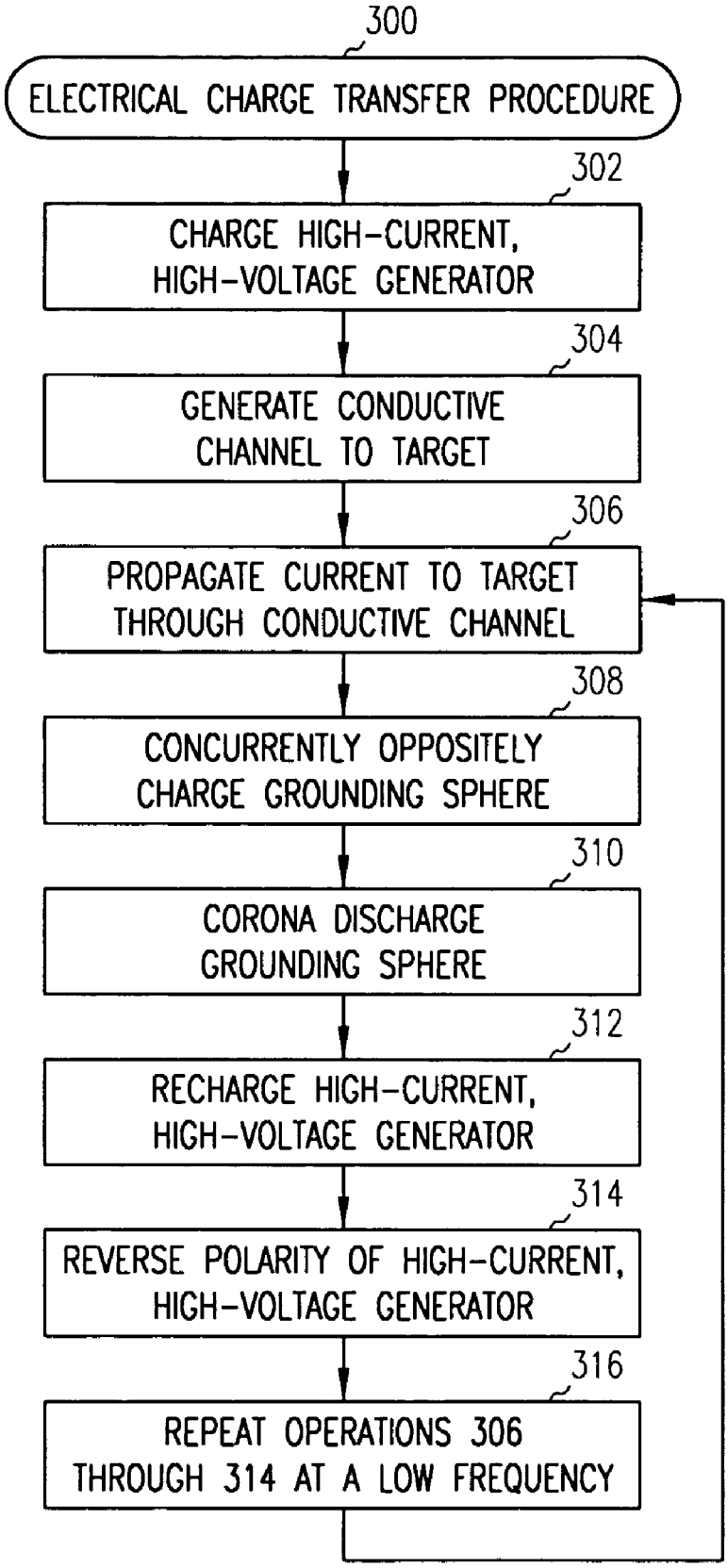
FIG. 3 is a flow chart of an electrical charge transfer procedure in accordance with some embodiments of the present invention.

FIG. 3 is a flow chart of an electrical charge transfer procedure in accordance with some embodiments of the present invention. Procedure 300 may be performed by a device, such as single-path electrical device 200 (FIG. 2) or single-path electrical device 100 (FIG. 1), for transferring charge through a conductive channel to a target. In some embodiments, system controller 210 (FIG. 2) may control the performance of the operations of procedure 300 described below, although the scope of the invention is not limited in this respect.

Operation 302 comprises charging a high-current, high voltage generator with sufficient charge to propagate through a conductive channel to the target. In some embodiments, high-current, high-voltage generator 204 (FIG. 2) may be charged in operation 302, although the scope of the invention is not limited in this respect.

Operation 304 comprises generating a conductive channel to the target. In some embodiments, the conductive channel may correspond to conductive channel 206 (FIG. 2) and may be either a conductive plasma channel comprising conductive plasma, a conductive wire channel comprising one or more wire conductors, or a conductive fluid channel comprising a conductive fluid stream. Operation 304 may be performed by conductive path generator 208 (FIG. 2), although the scope of the invention is not limited in this respect. When the conductive channel is a conductive plasma channel, it may be generated by an electric arc, or it may be generated by firing a laser to photo-ionize air prior to propagating a high-voltage electrical current.

Operation 306 comprises propagating an electric charge (e.g., current) through the conductive channel. In some embodiments, the charge may be generated by the high-current, high-voltage generator that was charged in operation 302. In some embodiments, the charge may be propagated through the channel to a target. The target may at least temporarily store or retain the charge.

Operation 308 comprises oppositely charging a grounding surface element, such as grounding surface element 202 (FIG. 2), with an amount of charge approximately equal to the amount of charge conveyed through the channel to the target in operation 306. In some embodiments, operations 306 and 308 may be performed substantially concurrently by high-current high-voltage generator 204 (FIG. 2) to store a substantially equal and opposite charge on grounding surface element 202 (FIG. 2) as conveyed through conductive channel 206 (FIG. 2).

Operation 310 comprises discharging at least some of the charge from the grounding surface element by corona discharge. In some embodiments, grounding surface element 202 (FIG. 2) may discharge at least some charge using one or more of corona point 214 (FIG. 2), although the scope of the invention is not limited in this respect.

Operation 312 comprises recharging the high-current, high-voltage generator that was used to convey charge in operations 306 and 308. In some embodiments, operation 312 may be performed concurrently with operation 310, although the scope of the invention is not limited in this respect.

Operation 314 comprises reversing the polarity of the high-current, high-voltage generator. In some embodiments, operation 314 may be performed by a switch, such as switch 204A (FIG. 2), while in other embodiments, operations 312 and 314 may be performed by an alternating polarity Marx generator, although the scope of the invention is not limited in this respect.

Operation 316 comprises repeating operations 306 through 314 at a low frequency. The performance of operations 306 through 314 may maintain a conductive channel to the target and may propagate and remove charge from the target to cause some effect on the target. This effect may be independent of whether the target or the device performing procedure 300 is grounded. In some embodiments, operation 316 may comprise repeating operations 306 through 314 at a higher frequency (e.g., greater than 50 Hz and possibly up to several hundred kHz) depending on the type of target.

Although the individual operations of procedure 300 are illustrated and described as separate operations, one or more of the individual operations may be performed concurrently, and nothing requires that the operations be performed in the order illustrated. Some embodiments of the invention may be implemented in one or a combination of hardware, firmware and software.

Figure 4:
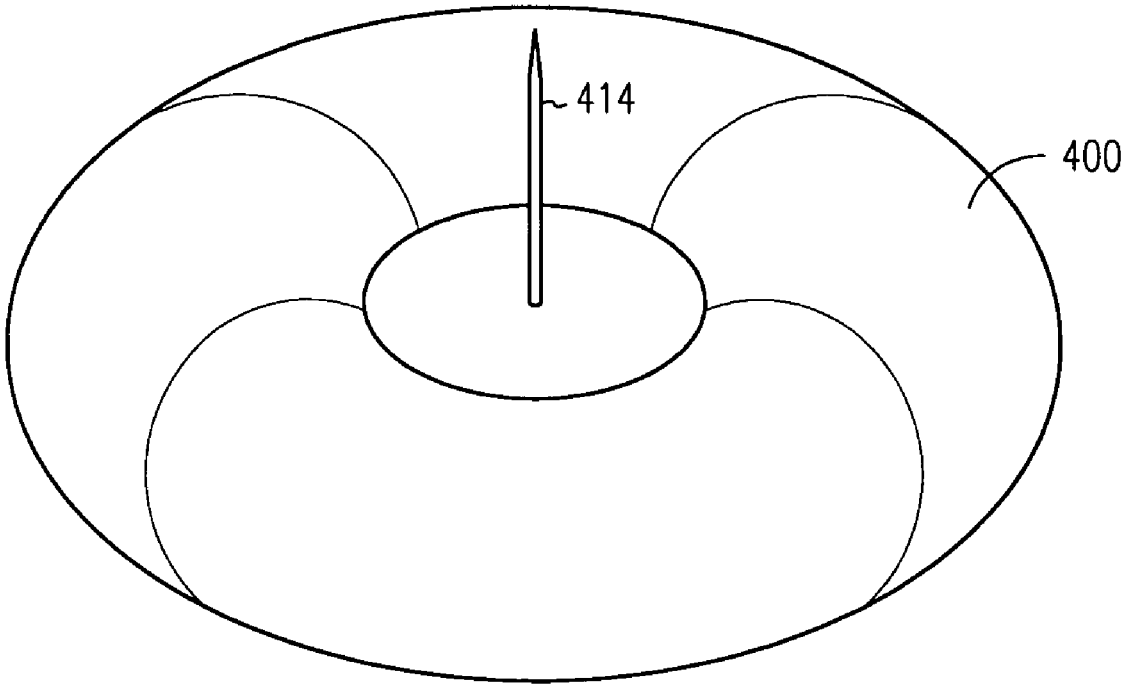
FIG. 4 illustrates a torroidal grounding element suitable for use with some embodiments of the present invention.

FIG. 4 illustrates a torroidal grounding element suitable for use with some embodiments of the present invention. Torroidal grounding element 400 may be suitable for use as grounding surface element 102 (FIG. 1) and may be used for grounding surface element 202 (FIG. 2). Torroidal grounding element 400 may include one or more corona points 414, corresponding with one or more of corona points 114 (FIG. 1) and corona points 214 (FIG. 1). Corona points 414 may be needle shaped, although the scope of the invention. In reference to FIG. 1, corona point 414 of torroidal grounding element 400 may point downward and at least slightly away from a user. In some embodiments, single-path electrical device 100 (FIG. 1) may include two torroidal grounding element 400 located on each side of single-path electrical device 100.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims.

In the foregoing detailed description, various features are occasionally grouped together in a single embodiment for the purpose of streamlining the disclosure. This method of disclosure is not to be interpreted as reflecting an intention that the claimed embodiments of the subject matter require more features than are expressly recited in each claim. Rather, as the following claims reflect, invention may lie in less than all features of a single disclosed embodiment. Thus the following claims are hereby incorporated into the detailed description, with each claim standing on its own as a separate preferred embodiment.

What is claimed is:

1. A device for transferring charge comprising:

a conductive-path generator to generate a conductive plasma channel;

a grounding surface element; and a high-current, high-voltage generator to propagate a high-voltage electrical charge through the conductive plasma channel, and to concurrently provide an opposite amount of charge to the grounding surface element, wherein the grounding surface element serves as a return path and is to receive and store the opposite amount of charge when the high-voltage electrical charge is propagated through the channel, and wherein the conductive plasma channel is generated prior to the propagation of the high-voltage electrical charge through the conductive plasma channel.

2. A device for transferring charge comprising:

a conductive-path generator to generate a conductive channel;

a grounding surface element; and a high-current, high-voltage generator to propagate a high-voltage electrical charge through the conductive channel, and to concurrently provide an opposite amount of charge to the grounding surface element, wherein the grounding surface element comprises either a grounding sphere or a grounding torroid having a surface area to store an amount of charge substantially equal and opposite to an amount of charge conveyed by the high-voltage generator through the conductive channel.

3. The device of claim 2 wherein the device is ungrounded, and wherein the grounding surface element has a corona point to dissipate charge stored thereon.

4. The device of claim 2 wherein the conductive channel is a single conductive channel comprising a single conductive current path.

5. The device of claim 4 wherein the high-current, high-voltage generator is an alternating polarity generator to regularly reverse charge flow through the single conductive channel at a low frequency.

6. The device of claim 5 wherein the alternating-polarity generator propagates and reverses the charge flow through the conductive channel to either stun, shock or incapacitate an ungrounded target by transferring charge to and removing charge from the target at the low frequency, and wherein the low frequency is less than approximately 50 Hz.

7. The device of claim 5 wherein the grounding surface element has a corona point to dissipate at least some of the charge each time the charge flow is reversed by the high-voltage generator.

8. The device of claim 2 wherein the conductive-path generator generates the conductive channel to a target, and wherein the high-current, high-voltage generator propagates the high-voltage electric charge through the conductive channel to the target.

9. The device of claim 2 wherein the conductive-path generator comprises a laser which is to generate a conductive plasma channel by firing the laser to photo-ionize air prior to the high-voltage generator propagating the high-voltage electrical charge through the conductive plasma channel.

10. The device of claim 2 wherein the conductive-path generator generates a conductive wire channel comprising a wire conductor by firing the wire conductor to a target.

11. The device of claim 2 wherein the conductive channel comprises a conductive fluid stream, and wherein the conductive-path generator pressurizes a fluid and fires the fluid to generate the conductive fluid stream to a target.

12. The device of claim 11 wherein the grounding surface element is a first grounding surface element, wherein the device further comprises a second grounding surface element electrically parallel to the first grounding surface element, wherein the first and second grounding surface elements are located on opposite sides of the device, and wherein the first and second grounding surface elements are located in substantially horizontal opposite positions.

13. The device of claim 2 wherein the high-current, high-voltage generator is an alternating polarity Marx generator which reverses the direction of charge through the conductive channel at a low frequency.

14. The device of claim 2 further comprising:

a system controller; and a switch, wherein the controller is responsive to the switch to charge the high-current, high-voltage generator, and to instruct the conductive-path generator to generate the conductive path.

15. The device of claim 14 wherein the device is a hand-held conductive stream device, and wherein the switch comprises a trigger.

16. A method comprising alternatively providing and removing charge through a single conductive channel while concurrently removing charge from and providing charge to a grounding surface element, wherein the alternatively providing and removing charge through the single conductive channel is performed at a low frequency to either stun, shock or incapacitate an ungrounded target by transferring charge to and removing charge from the target at the low frequency, and wherein the grounding surface element is either a grounding sphere or a grounding torroid.

17. The method of claim 16 further comprising generating the conductive channel through air to the target, wherein the charge is alternatively provided to the target and removed from the target through the conductive channel, and wherein the low frequency is less than approximately 50 Hz.

18. The method of claim 17 wherein concurrently removing charge from and providing charge to the grounding surface element comprises storing charge on a surface area of the grounding surface element, wherein an amount of charge stored is substantially equal and opposite to an amount of charge conveyed through the conductive channel, and wherein the method further comprises dissipating at least some of the charged stored on the grounding surface element through a corona point.

19. The method of claim 18 wherein generating the conductive channel comprises firing a laser to photo-ionize air prior propagating a high-voltage electrical current through the conductive channel, the channel being a conductive plasma channel.

20. The method of claim 18 wherein generating the conductive channel comprises generates a conductive wire channel comprising a wire conductor by firing the wire conductor to contact the target.

21. The method of claim 18 wherein generating the conductive channel comprises pressurizing a fluid and firing the fluid to generate a conductive fluid stream to contact the target, and wherein the grounding surface element is one of at least two oppositely positioned grounding surface elements comprising either grounding spheres or grounding torroids.

22. A single-beam electrical device comprising:

a grounding surface element; and a high-current, high-voltage generator to propagate a high-voltage electrical charge through a conductive channel to a target and to concurrently provide an opposite amount of charge to the grounding surface element, wherein the grounding surface element comprises either a grounding sphere or grounding torroid.

23. The device of claim 22 wherein the device is a hand-held conductive stream device further comprising:

a trigger; and a conductive-path generator to generate the conductive channel through the air to the target in response to action by the trigger, wherein the high-current, high-voltage generator is to propagate the high-voltage electrical charge through the conductive channel in response the action by the trigger.

24. The device of claim 23 wherein the grounding surface element has a surface area to store an amount of charge substantially equal and opposite to an amount of charge conveyed by the high-voltage generator through the conductive channel, wherein the device is ungrounded, and wherein the grounding surface element has a corona point to dissipate at least some charge stored thereon.

25. The device of claim 24 wherein the conductive channel is a single conductive channel comprising a single conductive current path, and wherein the high-current, high-voltage generator is an alternating polarity generator to regularly reverse charge flow through the single conductive channel at a low frequency, the low frequency being less than approximately 50 Hz.

26. The device of claim 25 wherein the conductive-path generator generates a conductive wire channel comprising a wire conductor by firing the wire conductor to a target.

27. The device of claim 25 wherein the conductive channel comprises a conductive fluid stream, and wherein the conductive-path generator pressurizes a fluid and fires the fluid to generate the conductive fluid stream to a target.

28. The device of claim 27 wherein the grounding surface element is a first grounding surface element, wherein the device further comprises a second grounding surface element electrically parallel to the first grounding surface element, wherein the first and second grounding surface elements are oppositely positioned with respect to the conductive fluid stream.

29. An air-to-air device:

a high-current, high-voltage generator to propagate a high-voltage electrical charge through a conductive plasma channel to a target and to concurrently provide an opposite amount of charge to a grounding surface element; and a conductive path generator to generate the conductive plasma channel prior to the propagation of the high-voltage electrical charge through the conductive plasma channel, wherein the air-to-air device is part of an airborne platform comprising either a missile or aircraft, and wherein the grounding surface element is an external conductive surface of the airborne platform, serves as a return path, and is to receive and store the opposite amount of charge when the high-voltage electrical charge is propagated through the channel.

30. The device of claim 29 wherein the target comprises a second airborne platform comprising either a missile or aircraft, and wherein the device further comprises a conductive-path generator comprising a laser which generates a conductive plasma channel by firing the laser at the target to photo-ionize atmosphere prior to the high-voltage generator propagating the high-voltage electrical charge through the conductive plasma channel to the target.

* * * * *